United States Patent [19]

Hansen

[11] Patent Number: 4,976,409

[45] Date of Patent: Dec. 11, 1990

[54] ADJUSTABLE PICTURE HANGER

[76] Inventor: Willy Hansen, 23 Echo La., Warwick, N.Y. 10990

[21] Appl. No.: 492,537

[22] Filed: Mar. 12, 1990

[51] Int. Cl.[5] ..... A47G 1/00

[52] U.S. Cl. ..... 248/469; 248/125; 248/473; 248/498

[58] Field of Search ..... 248/469, 470, 471, 476, 248/473, 497, 498, 125, 413

[56] References Cited

U.S. PATENT DOCUMENTS

| | | | |
|---|---|---|---|
| 338,556 | 3/1886 | Osborn | 248/469 X |
| 3,184,207 | 5/1965 | Hermanns et al. | 248/413 |
| 3,370,821 | 2/1968 | Mingis | 248/498 X |
| 4,449,688 | 5/1984 | Robins | 248/476 X |
| 4,817,906 | 4/1989 | Ellison | 248/476 X |

FOREIGN PATENT DOCUMENTS

| | | | |
|---|---|---|---|
| 44264 | 10/1910 | Fed. Rep. of Germany | 248/469 |
| 363116 | 11/1922 | Fed. Rep. of Germany | 248/498 |
| 808250 | 7/1951 | Fed. Rep. of Germany | 248/125 |
| 4374 | of 1881 | United Kingdom | 248/469 |

*Primary Examiner*—David L. Talbott

*Attorney, Agent, or Firm*—Parmelee, Bollinger & Bramblett

[57] ABSTRACT

A picture frame stand has a pedestal and tubular sleeve vertically mounted from the pedestal. An open vertical slot extends along a substantial length of the sleeve which houses a pole mounted for vertical movement in the sleeve. A screw is anchored near the lower end of the pole and is positioned for slideable movement in the slot and a nut is mounted on this screw for holding the pole in a fixed position in the slot when the desired height of the pole is reached. Accordingly, the adjustment of the pole in the sleeve is obtained by loosening the nut and moving the screw up and down in the slot. A peg is provided on the upper end of the pole adapted to rece' 'e a picture hanger. The hanger has a general horseshoe configuration terminated in a plate which is mounted on a picture frame. The plate has a horizontal slot therein with the screw positioned in the slot permitting horizontal movement of the hanger on the frame for providing an adjustment. When the hanger is mounted on a picture frame and is positioned on the peg on the stand, the lower portion of the frame rests on the pedestal providing a very secure and attractive mount for the picture frame.

2 Claims, 2 Drawing Sheets

Fig. 5.
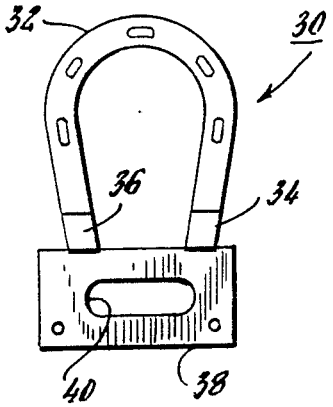
Fig. 6.
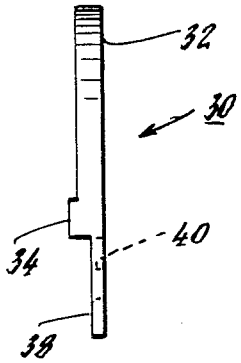
Fig. 7.
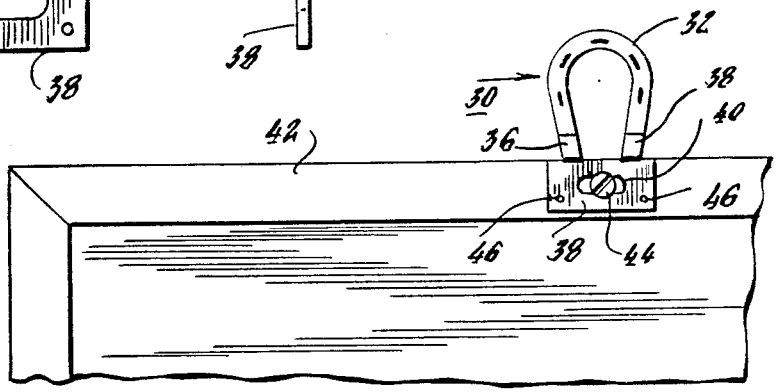
Fig. 8.
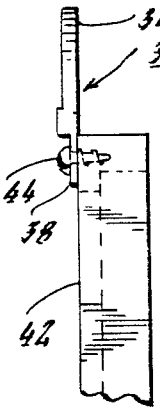
Fig. 9.
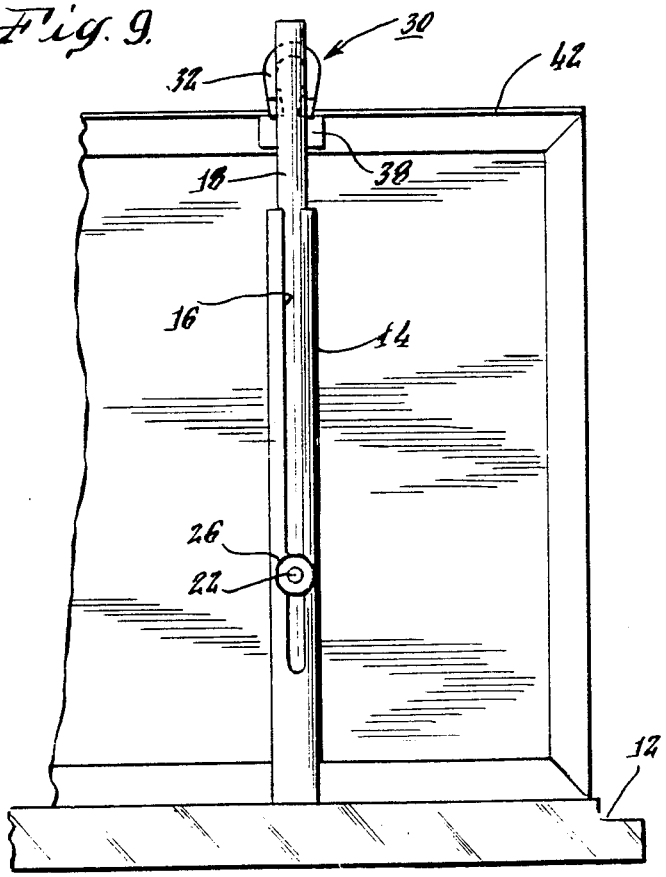
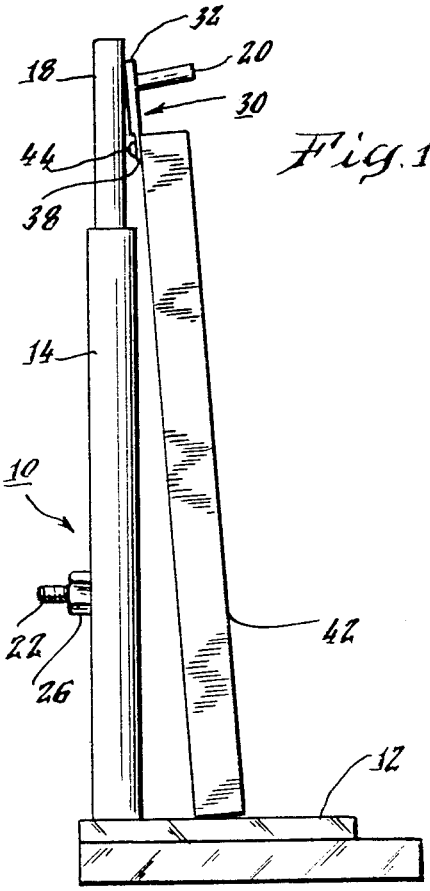
Fig. 10.

ADJUSTABLE PICTURE HANGER

BACKGROUND OF THE INVENTION

This invention relates to a picture frame stand and hanger which are adjustable to accommodate different size pictures within a predetermined range to provide a very stable and decorative type holder for positioning and displaying a picture.

Many self-standing frames for housing photos and pictures which are adapted to be self-standing on desks, dressers, tables, etc. generally involve a foldable flap on the back panel of the frame which is folded outward and forms an angle with the back panel. The frame then sits on the surface and is leaned backwards on the flap for supporting the frame in an angled upright position. The problem with these type of mounts is that they are generally made of cardboard, paper or some other material which is subject to bending out of shape and failing to support the frame on which it is mounted. In other words, instead of supporting the frame in an upright leaning position, after a period of time the angled mounting flap begins to bend reducing the angle between the surface on which the frame is mounted until the angle flap no longer supports the frame in its nearly upright position. In addition, such flaps even if they do not deform are fairly unstable such that the picture frame is easily knocked over damaging the frame, the glass cover and/or the picture or document which is mounted in the frame. Not only is instability a problem, such flaps and mountings are unsightly.

SUMMARY OF THE INVENTION

Accordingly, it is an object of this invention to provide a new and improved stand and hanger for mounting a picture thereon which is decorative, stable and relatively inexpensive.

Still a further object of this invention is to provide a new and improved picture frame stand and hanger therefor in which the stand and hanger are adjustable to permit the mounting of a range of frames on the stand and hanger within the range of adjustment of the stand and hanger.

Still a further object of this invention is to provide a new and improved hanger and stand for holding a picture frame which is attractive, relatively inexpensive and suitable for positioning pictures on flat surfaces such as tables, desks, dressers, etc.

In carrying out this invention in one illustrative embodiment thereof, an adjustable picture stand and hanger has a pedestal with a tubular sleeve vertically mounted thereon. The sleeve has an open slot extending vertically along a substantial length thereof. A pole is mounted for vertical movement in the sleeve and has a peg on one end thereof which extends outwardly above the pedestal and is adapted to receive a hanger of a picture frame thereon with the picture frame resting on the pedestal. A screw is anchored near the second end of the pole and is positioned for slideable movement in the slot and carries a nut for holding the pole in a fixed position in the slot when the screw is tightened when the desired height of the pole is provided. Thus, a means for adjusting the height of the pole in the sleeve is provided when the nut is loosened.

The hanger is preferably a generally horseshoe-shaped configuration terminated in a mounting plate which is affixed to the top of the picture frame with the plate having a slot extending horizontally therein and a screw positioned therein which may be moved in the slot for adjusting the centering of the frame as it hangs on the peg of the stand. The adjustable pole and hanger accommodate the mounting of different sized frames on the adjustable stand and hanger.

BRIEF DESCRIPTION OF THE DRAWINGS

The invention, together with further objects, advantages, features and aspects thereof will be more clearly understood from the following description taken in connection with the accompanying drawings.

FIG. 5 is a front view of the horseshoe-shaped hanger in accordance with the present invention.

FIG. 6 is a side elevational view of the hanger shown in FIG. 5.

FIG. 7 is a partial view of a picture frame having the adjustable hanger of FIG. 5 shown positioned thereon.

FIG. 8 is a side elevational view of FIG. 7.

FIG. 9 is a partial rear view of a frame carrying the adjustable hanger mounted on the stand in accordance with the present invention.

FIG. 10 is a side elevational view of the frame mounted on the stand in accordance with the present invention.

DESCRIPTION OF THE PREFERRED EMBODIMENTS

Figure 1:
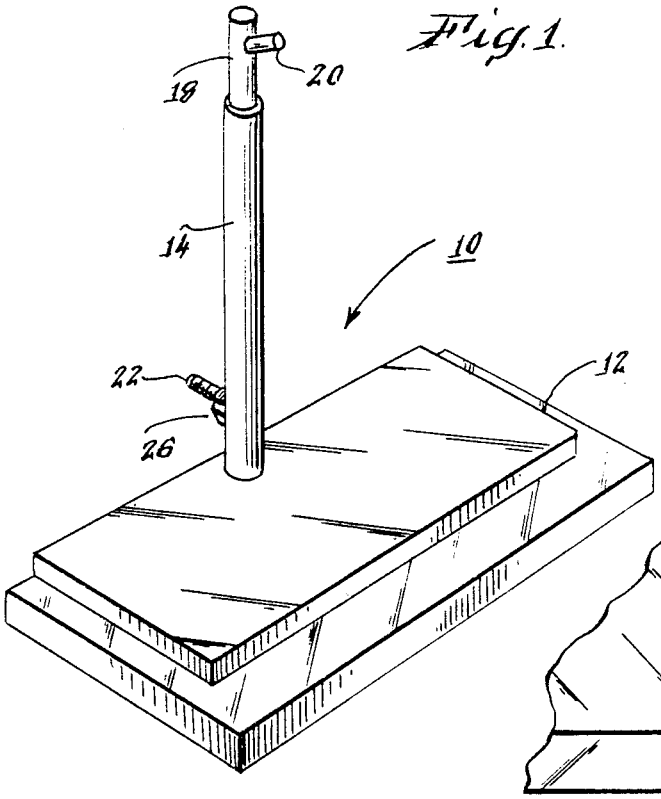
FIG. 1 is an isometric view of the adjustable stand in accordance with the present invention.
Figure 2:
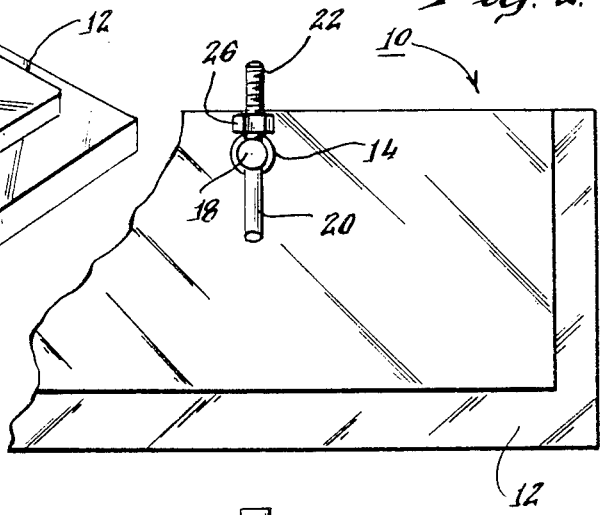
FIG. 2 is a partial top view of FIG. 1.
Figure 3:
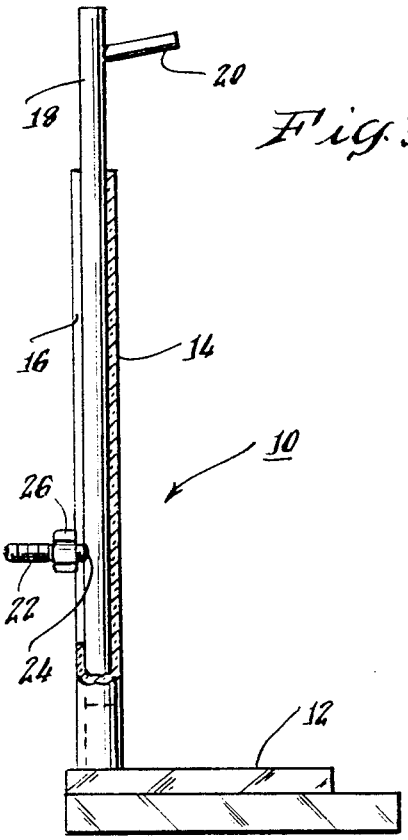
FIG. 3 is a side elevational view of FIG. 1.
Figure 4:
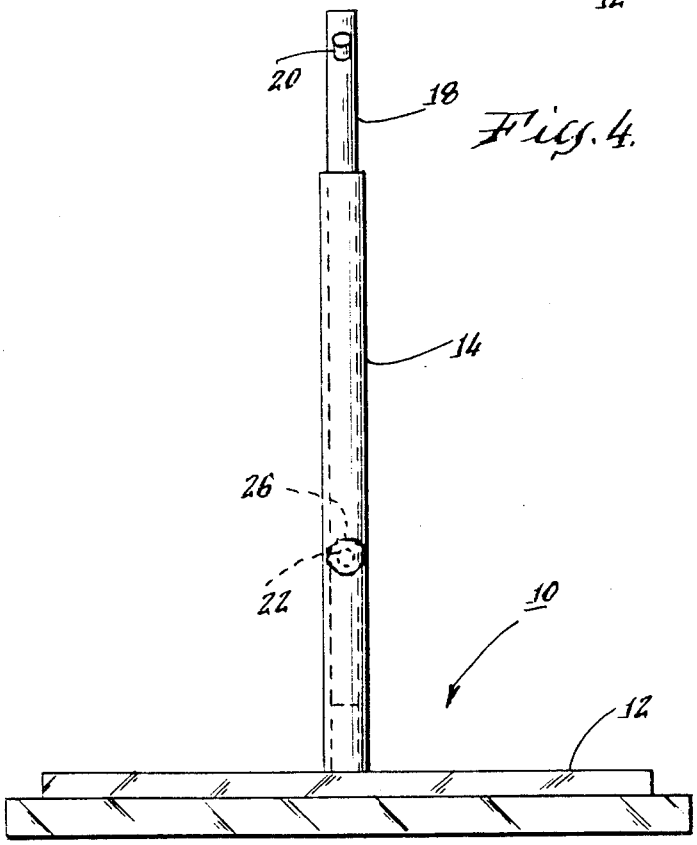
FIG. 4 is a front elevational view of FIG. 1.

Referring now to FIGS. 1–4, a picture frame stand, referred to generally with the reference numeral 10, has a pedestal base 12 with a vertically mounted sleeve 14 extending upwardly therefrom on the central back portion of the pedestal 12. The sleeve 14 has a slot 16 therein which extends a substantial length of the sleeve as best seen in FIG. 3. A pole 18 is positioned for slideable movement in the sleeve 14. The pole has a peg 20 mounted near the upper end thereof which extends outwardly above the pedestal 12. The pole 18 has a screw 22 anchored at 24 in the other end of the pole 18. The anchored screw 22 is mounted for slideable movement in the slot 16 of the sleeve 14. A nut 26 is mounted on the screw 22 and provides a means for adjusting the pole 18 in the sleeve 14.

In operation, the nut 26 is loosened and the height of the pole 18 is adjusted to the level desired by the user in accordance with the size of the picture frame which is to be positioned on the stand 10. The nut 26 is then tightened securing the pole 18 in position on the stand. If a different position is desired, nut 26 is simply loosened and the pole is slid up or down as desired and the nut tightened again to affix the position of the pole 18 firmly in the sleeve 14.

Referring now to FIG. 5, an adjustable hanger, referred to generally with the reference numeral 30, has a generally horseshoe-shaped body 32 having legs 34 and 36 terminated in a mounting plate 38 having a longitudinal slot 40 therein. The adjustable hanger 30 is mounted on a picture frame 42 as illustrated in FIGS. 7 and 8 using a screw 44 positioned in the slot 40 and affixing the hanger 30 to the top of the frame 42. The hanger 30 is placed in the center of the top of the frame 42 and mounted thereon by the screw 44. If when hung the picture frame 42 isn't quite straight, the screw 44 may be loosened and moved toward the slanted side and fastened again. Holes 46 are also provided in the plate and if desired, small nails may be placed in the pin holes 46 to permanently affix the plate 38, and accordingly the hanger 30 to the frame 42.

As will be seen in FIGS. 9 and 10, the picture frame 42 is mounted on the stand 12 with the hanger 30 being positioned on the peg 20 of the pole 18 with the bottom of the frame 42 resting at a slight angle from 90° with the pedestal base 12. The elevation of the pole 18 is adjustable as previously described to accommodate variable sized frames. Also, the position of the hanger 30 is horizontally adjustable for centering the frame in its mounting on the pedestal. Since the frame 42 is positioned both on the peg 20 and rests on a slight angle to the perpendicular on the pedestal 12, a stable mounting at a fixed angle which will not vary is provided. These alleviates the problem of angled mounting flaps which are typically utilized for positioning a frame in an upright position on a flat surface. The stand is preferably made of acrylic which comes in rods, tubes and plates, and accordingly is easy to fabricate, relatively inexpensive and provides a very decorative and attractive mount for any type of picture frame, award, plague, etc.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. An adjustable picture stand and hanger having a height adjustment range for mounting a picture frame within a predetermined size range on said picture stand comprising:

a pedestal;

a tubular sleeve vertically mounted on said pedestal, said sleeve having an open slot extending vertically from an end of said sleeve remote from said pedestal along a substantial length of said sleeve;

a pole having first and second ends thereon, said pole being mounted for vertical movement in said sleeve and having a peg mounted near said first end of said pole extending outwardly extending at an upward angle from and above said pedestal and adapted to have a hanger of a picture frame positioned thereon which frame rests on said pedestal;

a screw anchored near the second end of said pole and being positioned for slideable movement in said slot of said sleeve;

a nut mounted on said screw for holding said pole in a fixed position in said slot when tightened therein when the desired height of said pole is provided and for adjusting the height of said pole in said sleeve when said nut is loosened, and having a picture frame mounted thereon, a hanger mounted on the top of said frame positioned on said peg and having the bottom of the frame resting on said pedestal.

2. The adjustable picture stand and hanger as claimed in claim 1 wherein said hanger has a generally horseshoe configuration terminated in a mounting plate having a slot extending horizontally therein with a screw positioned therein thereby providing an adjustment for centering said hanger by moving said screw in said horizontal slot thereby centering said frame on said peg.

* * * * *